US005341984A

United States Patent [19]

Fogle

[11] Patent Number: 5,341,984

[45] Date of Patent: Aug. 30, 1994

[54] CARTON WITH RECLOSABLE SIDE POUR OPENING

[75] Inventor: James C. Fogle, Marietta, Ga.

[73] Assignee: Riverwood International Corporation, Atlanta, Ga.

[21] Appl. No.: 128,922

[22] Filed: Sep. 29, 1993

[51] Int. Cl.[5] ..... B65D 5/70

[52] U.S. Cl. ..... 229/215; 229/218; 229/222; 229/231

[58] Field of Search ..... 229/149, 214, 215, 218, 229/221, 222, 239; 206/264

[56] References Cited

U.S. PATENT DOCUMENTS

| | | | |
|---|---|---|---|
| 1,956,238 | 4/1934 | Jackson | 229/149 |
| 2,403,138 | 7/1946 | Sullivan | 229/218 |
| 2,501,842 | 3/1950 | Cartwright | 229/215 |
| 2,773,634 | 12/1956 | Negoro | 229/218 |
| 3,079,063 | 2/1963 | Yezek | 229/222 |
| 3,814,301 | 6/1974 | Niepmann | 206/264 |
| 4,154,346 | 5/1979 | Heuberger | 229/215 |
| 4,718,557 | 1/1988 | Friedman | 229/222 |
| 4,913,292 | 4/1990 | Field | 229/231 |
| 5,110,042 | 5/1992 | Hurden | 229/215 |

FOREIGN PATENT DOCUMENTS

| | | | |
|---|---|---|---|
| 703597 | 2/1965 | Canada | 229/215 |
| 158597 | 10/1985 | European Pat. Off. | 229/215 |
| 3832544 | 3/1990 | Fed. Rep. of Germany | 229/215 |

*Primary Examiner*—Gary E. Elkins

[57] ABSTRACT

A carton with an opening through which the contents can be poured. An opening in an end panel is normally covered by a closure flap connected to the top panel. The flap is maintained in closed position by another flap which includes a tear strip. Removal of the tear strip permits access to the closure flap, enabling it to be opened for pouring. A slot in the end panel receives the closure flap when the closure flap is reclosed.

19 Claims, 3 Drawing Sheets

CARTON WITH RECLOSABLE SIDE POUR OPENING

FIELD OF THE INVENTION

This invention relates to cartons for packaging pourable material. More particularly, it relates to cartons of this type which contain closable pouring openings.

BACKGROUND OF THE INVENTION

It is well known to package dry particulate material in boxes or cartons from which it can be poured. Cereal, for example, is conventionally packaged in rectangular boxes having a top panel formed from overlapping flaps connected to the side panels and underlying glue flaps connected to the end panels. The package is opened by separating the outer top panel flap from the inner top panel flap, and is closed by inserting an end tab on the outer flap into a locking slot in the inner flap. The slot is initially hidden from view by the overlapping flap and is exposed upon separating the two flaps. A common complaint against this package design is the difficulty in separating the flaps. The glue adhering the overlapping flaps to each other and to the underlying short glue flaps is often so strong or so liberally applied that the outer flap tears instead of separating along the glue line. If the tab is completely torn off, the top panel flaps cannot be connected together to close the package. Even if the tab is only partially torn or the outer flap is weakened by tearing in other areas, the flaps cannot normally be securely held in place after opening.

Another complaint against the conventional package has to do with pouring the contents. Pouring takes place over an end edge of the top opening and over the adjacent end glue flap. This relatively wide area makes it difficult to control the flow of the particles, sometimes resulting in the particles spilling out over the outer sides of the glue flaps.

When packaging heavier particulate material the carton can be too heavy to conveniently be lifted by grasping the sides of the carton. It would be preferable in these cases to carry the package by a handle instead. Moreover, if it is desired to have a wider carton for better stability and handleability or to more conveniently package greater quantities of material in a carton, a handle becomes necessary. Introduction of a handle, however, limits the area in the top panel in which a pouring opening can be provided. It would therefore be desirable to be able to employ a carton with a side pouring opening capable of directing the flow of particles poured from the carton and of being tightly reclosed to prevent spillage.

BRIEF SUMMARY OF THE INVENTION

The invention is incorporated in a carton having side panels, end panels and top and bottom panels. An opening in an upper portion of one of the end panels allows the contents of the carton to be poured, and a closure flap movable from closed to open position normally covers the opening. The carton includes means for maintaining the closure flap in closed position until the carton is initially opened, as well as means for maintaining it in closed position after being reclosed.

Preferably, the means for maintaining the closure flap in its initial closed position comprises an end flap which includes a tear strip overlying the closure flap. Upon removal of the tear strip the closure flap can be reached to uncover the pouring opening. Also, in the preferred embodiment the closure flap is foldably connected to an inner top panel flap and the end flap is foldably connected to an outer top panel flap which overlaps the inner top panel flap. The means for maintaining the closure flap in closed position after being reclosed is a slot in the end panel in which the end of the closure flap fits. A handle extending up from the top panel enables the carton to be lifted and tilted for pouring.

The carton can be readily opened without destroying or damaging its pouring and reclosing features and can be economically formed from a blank of generally rectangular shape.

These and other features and aspects of the invention, as well as its various benefits, will be made more clear in the subsequent detailed description of the preferred embodiment.

DETAILED DESCRIPTION OF THE PREFERRED EMBODIMENTS

Figure 1:
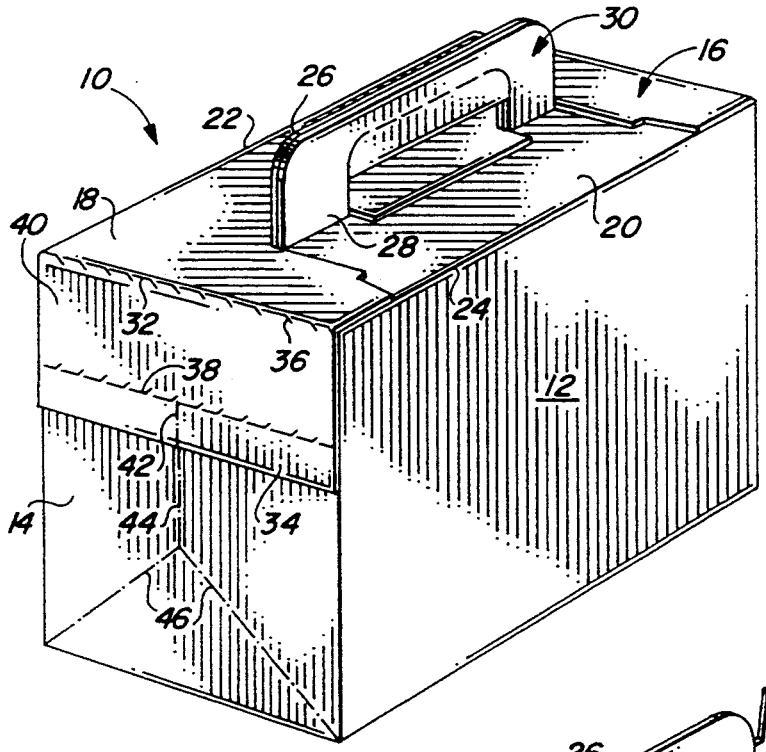
FIG. 1 is a pictorial view of a carton embodying the features of the invention.

Referring to FIG. 1, the carton 10 is comprised of side panels 12 connected to end panels 14, a top panel 16 and a bottom panel not visible in this view. Overlapping flaps 18 and 20, which are connected to their associated side panels by fold lines 22 and 24, form the top panel, and aligned handle sections 26 and 28, which extend up from the top panel flaps 18 and 20, form a handle 30. Connected to an end edge of the top panel flap 18 along fold line 32 is end flap 34. The end flap includes a tear line 36 coinciding with the fold line 32 and a second tear line 38 parallel to and spaced from the fold line 32. The tear lines thus create a tear strip 40 in the end flap 34. A short score line 42 in the end flap beneath the tear strip 40 is aligned with a vertical score line 44 in the end panel 14, and angled score lines 46 extend from the lower end of the score line 44 to the lower corners of the end panel.

Figure 2:
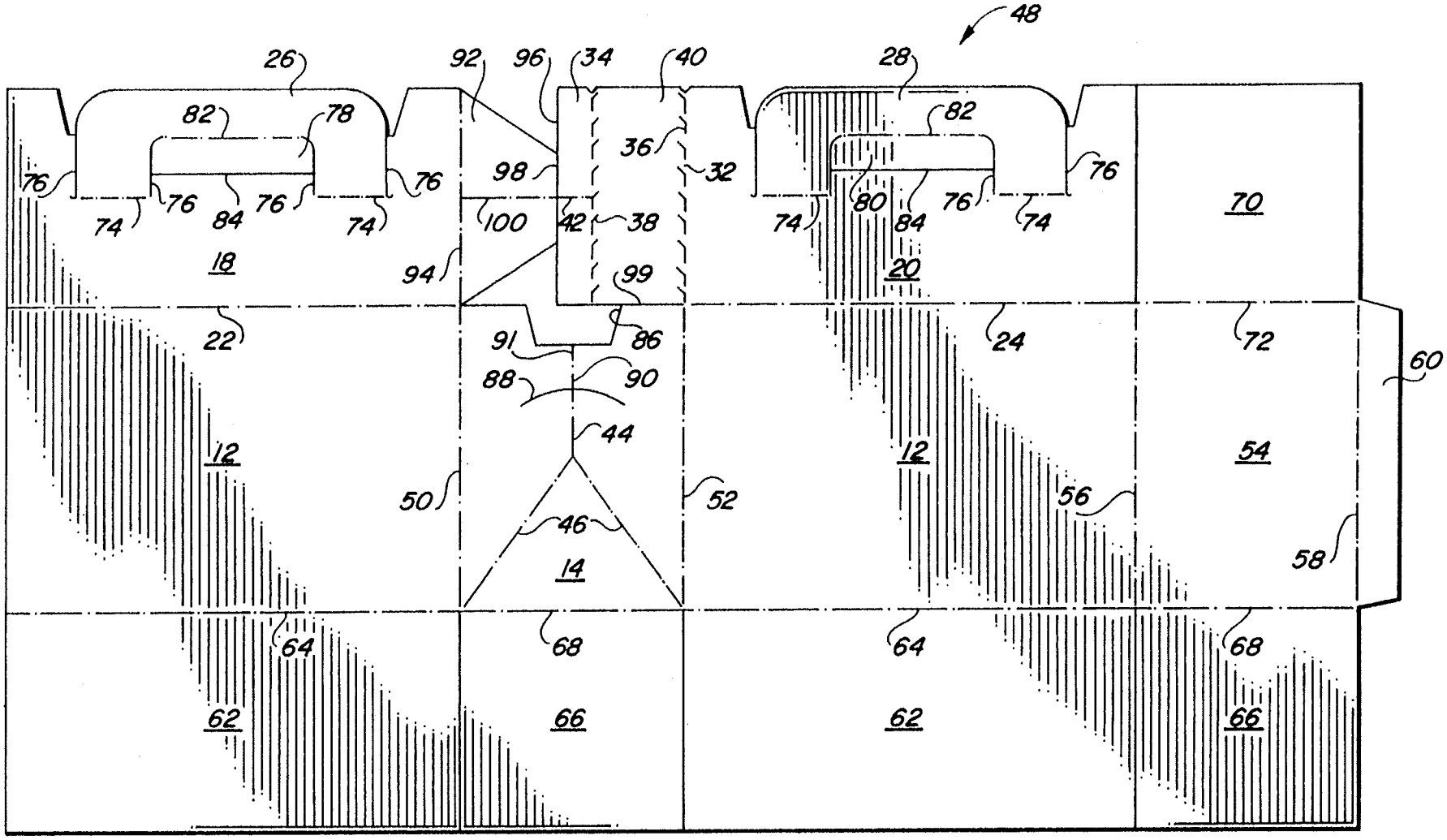
FIG. 2 is a plan view of a blank for forming the carton of FIG. 1.

A blank for forming the carton is shown in FIG. 2, wherein like reference numerals to those used in FIG. 1 refer to similar elements. The blank 48 is substantially rectangular in shape and comprised of a suitably strong, flexible material such as paperboard of the type conventionally employed in the carton and carrier industry. The end panel section 14 is located in the interior of the blank, connected on either side by fold lines 50 and 52 to the side panel sections 12. Another end panel section 54 is connected along fold line 56 to the interior side panel section 12 and at the other end along fold line 58 to glue flap 60. Bottom panel flaps 62 are connected to the side panel sections 12 by fold lines 64, and bottom panel glue flaps 66 are connected to the end panel sections 14 and 54 along fold lines 68.

A top panel glue flap 70 is connected to the end panel section 54 by fold line 72 and, as also shown in FIG. 1, the top panel flaps 18 and 22 are connected to the side panel sections 12 along fold lines 22 and 24, respectively. The handle sections 26 and 28 are connected to their top panel flaps 18 and 20 by fold lines 74, and are separated from the top panel flaps by slits 76. Handle tabs or flaps 78 and 80 are connected to the handles 26 and 28 along fold lines 82 and are separated from the top panel flaps by slits 84.

If the blank were to be used to form a conventional carton the space between the top panel flaps 18 and 20 would normally be utilized to form another glue flap similar to the glue flap 70 and the end panel section 14 would be similar to the end panel 54. Instead, the end panel section 14 includes an opening through which the contents of a carton can be poured and closure elements are provided in the space between the top panel flaps. Specifically, the end panel section 14 includes a cutout 86 which opens into the upper edge of the end panel section. An arcuate locking slit 88 is spaced from the opening and a short vertical slit 90, which facilitates separating the edges of the locking slit 88 during use, extends from the center of the slit 88 to a point spaced from the cutout. In addition, a short score line 91 extends from the upper end of the slit 90 to the lower edge of the opening 86.

A closure flap 92 is connected to the interior edge of the top panel flap 18 along fold line 94 and, as illustrated in FIG. 1, the end flap 34 is connected to the interior edge of the top panel flap 20 along fold line 32. The tear lines 36 and 38 delineate tear strip 40 in the end flap 34, one edge of which coincides with the fold line 32 and the other edge of which is spaced from the free edge 96 of the end flap 34. The adjacent edges of the closure flap 92 and the end flap 34 are separated in the blank by slit 98, while the adjacent edges of the end flap 34 and the end panel section 14 are separated by slit 99, which is aligned with fold line 24. A score line 100 in the closure flap 92 is aligned with the score line 42 in the end flap 34.

Figure 3:
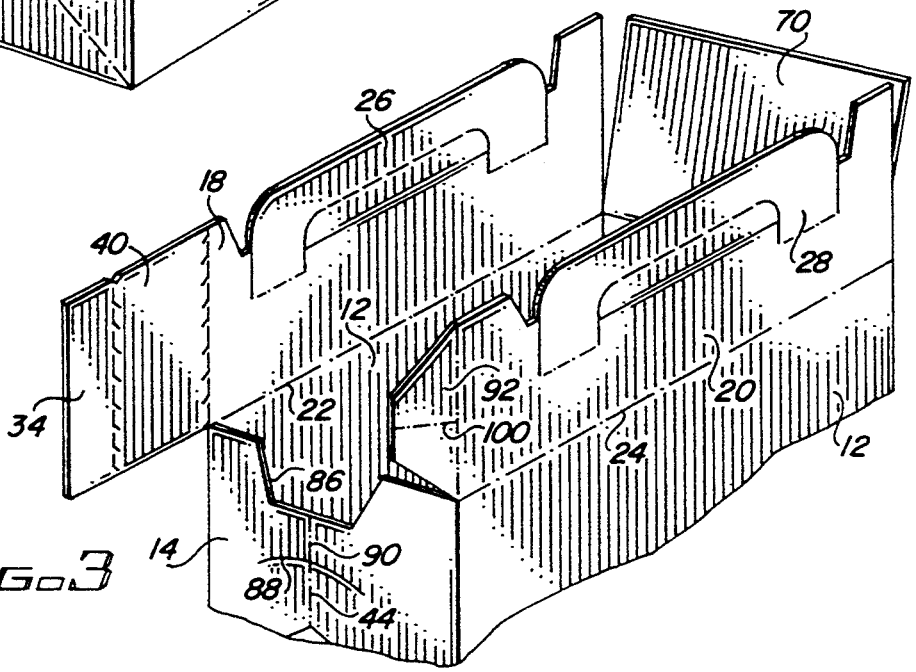
FIG. 3 is a partial pictorial view of the carton at an interim stage of fabrication.

To form a carton from the blank 48, the blank is folded about fold lines 50 and 56 and the glue flap 60 is adhered to the end side panel section 12 to form a collapsed sleeve. The sleeve is then squared up and the bottom panel formed in conventional manner by folding the bottom glue flaps 66 in, folding and adhering one of the bottom panel flaps 62 to the glue flaps and folding and adhering the other bottom panel flap to the first bottom panel flap. The resulting open-top carton is illustrated in FIG. 3, which shows the end flap 34 and closure flap 92 opposite each other, connected to their associated top panel flaps 20 and 18. The carton is filled with the flaps in the position shown or folded back even farther so as not to interfere with the filling process.

Figure 4:
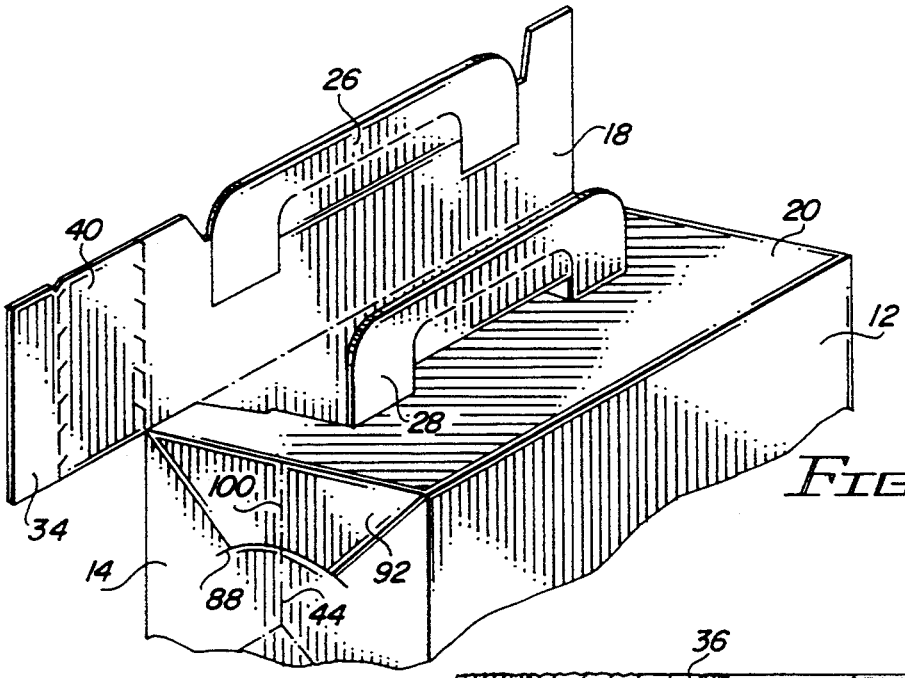
FIG. 4 is a partial pictorial view of the carton at a subsequent interim stage of fabrication.

After the carton has been filled glue is applied to the glue flap 70, after which it is folded down into horizontal position. The top panel flap 20 is then folded down and adhered to the glue flap 70. During this maneuver the handle section 28 is folded to its upright position and the closure flap 92 is folded about its fold line 94 to a position overlying the upper portion of the end panel 14, as shown in FIG. 4.

The final step is to apply glue to the underside of the top panel flap 18 and to the end portion of the flap 34 between the outer edge of the flap and the tear line 38, after which the top panel flap is folded into place. In doing so, the central portion of the top panel flap 18 moves under the handle flap 80 of the handle section 28 and the handle sections 26 and 28 are brought together to form the two-ply handle of the carton. The top panel flap 18 is thus adhered to the top panel flap 20 and the edge portion of the flap 34 is adhered to the end panel 14 at a location beneath the slit 88. The filled carton now appears as shown in FIG. 1.

Figure 5:
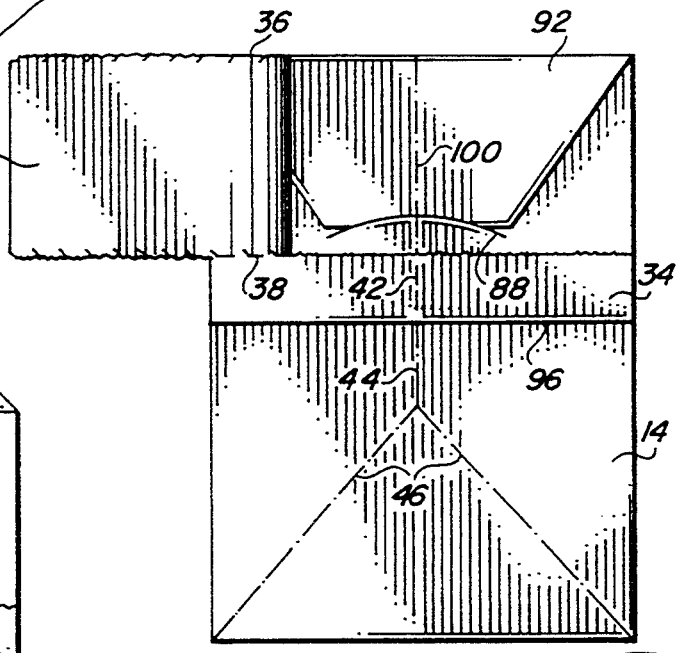
FIG. 5 is an end view of the carton during removal of the tear strip.
Figure 6:
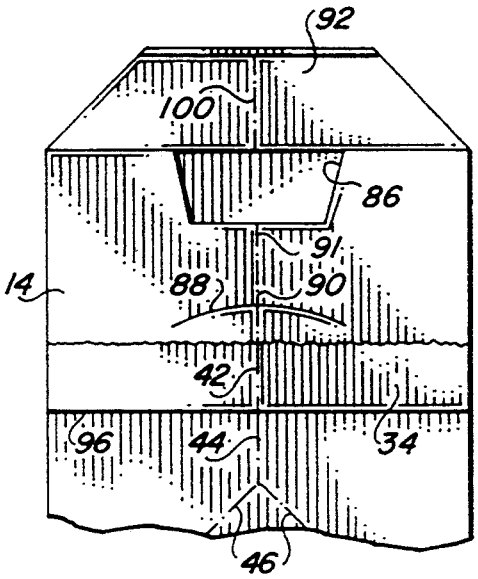
FIG. 6 is a partial end view of the carton similar to that of FIG. 5, but after the end closure flap has been folded up for pouring.

To open the carton the tear strip 40 is removed, as illustrated in FIG. 5. This is readily accomplished since the tear strip itself was not glued to the underlying surface. The edge portion of the end flap 34, which was glued to the end panel 14, remains in place beneath the slit 88. Removal of the tear strip gains access to the closure flap 92. Since the closure flap was not glued to the end panel 14, it can be pivoted up about fold line 94, as illustrated in FIG. 6. Since the closure flap at this point no longer covers the opening 86, the carton can be tilted and the contents poured through the opening, which thus functions in the manner of a spout. Lifting and tilting of the carton is made easy by the upstanding handle.

Figure 7:
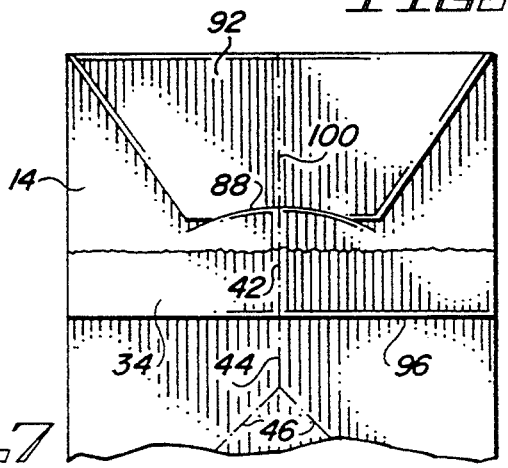
FIG. 7 is a partial end view similar to that of FIG. 6, but showing the closure flap after being reclosed.

When the pouring operation is finished, the end of the closure flap 92 is inserted in the slit 88, as illustrated in FIG. 7, to reclose the carton. The vertical slit 90 in the end panel 14 enables the edges of the slit to more readily separate to receive the end of the closure flap. Once the tear strip is removed, the upper edge of the end panel 14 is no longer protected by an adhered element of the carton and must be able to resist forces applied parallel to the end panel. The stress relief score lines 44 and 46 in the end panel 14 distribute stresses to the corners of the carton. The score lines 42 and 100 in the end flap 34 and the closure flap 92, respectively, as well as the score line 91, located directly beneath the pouring opening, also enable stresses to be distributed to the score line 44.

Figure 8:
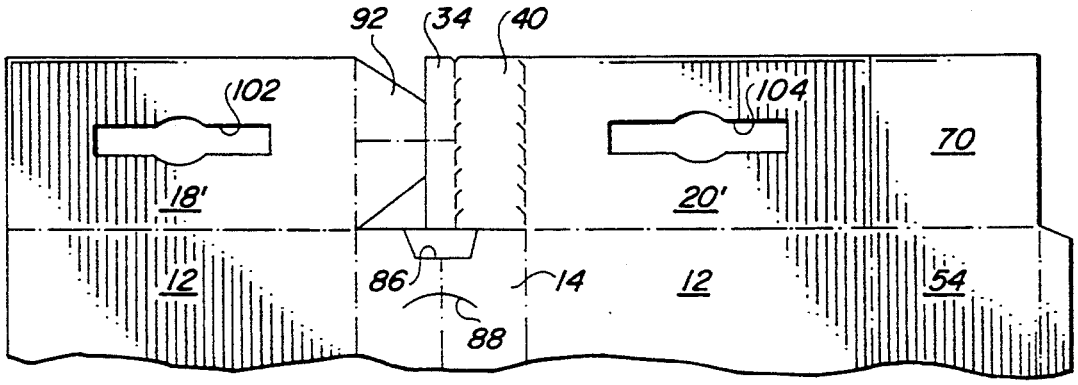
FIG. 8 is a partial plan view of a carton blank with a modified top panel flap design.

Although a particular type of top panel configuration and associated handle arrangement have been shown for purpose of illustration, it should be understood that the invention is not limited to such structure. For example, as shown in FIG. 8, the top panel flaps 18' and 20' may be of simpler design, not broken up by inclusion of a handle section but consisting simply of full panel sections containing central handle cutouts 102 and 104. When forming the top panel of a carton of this type, the two top panel flaps overlap, as in the formation of the bottom panel. The handle cutouts are aligned, permitting a separate handle to be adhered to the underlying top panel flap so as to extend up through the cutouts.

Regardless of the top panel and handle design, the end panel flap 34, the closure flap 92 and the end panel 14 remain the same, providing a cutout in the side panel through which the contents of the carton can be poured, a closure flap covering the opening which can be secured in place after the carton has been opened, and a tear strip overlying the closure flap for preventing premature access to the closure flap and opening. The opening itself, having a narrow pouring edge and surrounding side edges, guides and controls the flow of the carton contents in a manner superior to the pouring edge of cartons in which the entire upper edge of one of the end panels functions as the pouring edge.

The carton is economical to produce, being formed from a single blank of generally rectangular shape by means of a few simple folding and gluing steps which can be carried out by hand or in a packaging machine.

It can be carried easily by the upstanding handle, and it can be stored or shipped in stacked layers made possible by the ability of the handle to be moved out of the way, as by being folded down or depressed into its recess, depending on the particular top panel and handle design employed. Further, the ability to reclose the carton to a secure, tight condition is very beneficial.

It should be apparent that the invention is not necessarily limited to all the specific details described in connection with the preferred embodiments, but that changes to certain features of the preferred embodiments which do not alter the overall basic function and concept of the invention may be made without departing from the spirit and scope of the invention defined in the appended claims.

What is claimed is:

1. A carton for packaging pourable material, comprising:

side panels connected to end panels, a top panel and a bottom panel;

an opening in an upper portion of one of the end panels through which pourable material packaged in the carton may be poured;

a closure flap movable from closed position to open position, the closure flap covering the pouring opening when in closed position and being spaced from the opening when in open position;

an end flap overlying the closure flap for maintaining the closure flap in closed position until disabled; and means for maintaining the closure flap in closed position after the closure flap has been moved from open to closed position.

2. A carton as defined in claim 1, wherein the opening extends up to an upper edge of said one end panel.

3. A carton as defined in claim 1, wherein the end flap includes a tear strip overlying the closure flap, whereby removal of the tear strip provides access to the closure flap.

4. A carton as defined in claim 3, wherein an end portion of the end flap is adhered to said one end panel, the tear strip being situated between the adhered end portion of the end flap and the top panel.

5. A carton as defined in claim 1, wherein the top panel is comprised of two tap panel flaps, the closure flap being connected to one of the top panel flaps and the end flap being connected to the other top panel flap.

6. A carton as defined in claim 5, wherein one of the top panel flaps overlaps the other top panel flap, the closure flap being connected along a fold line to said other top panel flap and the end flap being connected along a fold line to said one top panel flap.

7. A carton as defined in claim 1, wherein the means for maintaining the closure flap in closed position after the closure flap has been moved from open to closed position comprises a slot in said one end panel for receiving an end portion of the closure flap.

8. A carton as defined in claim 1, wherein said one end panel includes score lines for distributing stresses to the bottom of the carton, the closure flap also including at least one score line overlying a score line in said one end panel.

9. A carton as defined in claim 1, including a handle extending up from the top panel.

10. A carton for packaging pourable material, comprising:

side panels connected to end panels, to a top panel and to a bottom panel, the top panel being comprised of two top panel flaps, one of the top panel flaps overlapping the other top panel flap;

an opening in an upper portion of one of the end panels through which pourable material packaged in the carton may be poured;

a closure flap being connected to said other top panel flap and being movable from closed position to open position, the closure flap covering the pouring opening when in closed position and being spaced from the opening when in open position;

an end flap overlying the closure flap and being connected to said one top panel flap, the end flap including a tear strip overlying the closure flap, whereby removal of the tear strip provides access to the closure flap; and means for maintaining the closure flap in closed position after the tear strip has been removed and the closure flap has been moved from open to closed position.

11. A carton as defined in claim 10, wherein the means for maintaining the closure flap in closed position after the closure flap has been moved from open to closed position comprises a slot in said one end panel, an end portion of the closure flap being adapted to fit into the slot.

12. A carton as defined in claim 10, including a handle extending up from the top panel.

13. A blank for forming a carton for packaging pourable material, comprising:

alternating side and end panel sections connected by first fold lines;

an opening in an upper portion of one of the end panel sections through which pourable material packaged in a carton formed from the blank may be poured;

bottom panel flaps connected to the side and end panel sections along second fold lines;

a top panel flap connected to each of the side panel sections by third fold lines;

a closure flap connected to an end portion of one of the top panel flaps, the closure flap being movable from closed position to open position in a carton formed from the blank, covering the pouring opening when in closed position and being spaced from the opening when in open position;

first means connected to the other top panel flap for maintaining the closure flap of a carton formed from the blank in closed position until disabled; and second means on said one end panel section for maintaining the closure flap in closed position after the closure flap has been moved from open to closed position.

14. A carton blank as defined in claim 13, wherein the opening in the upper portion of said one end panel section extends to an upper edge of said one end panel section.

15. A carton blank as defined in claim 14, wherein the first means for maintaining the closure flap of a carton formed from the blank in closed position comprises an end flap connected to an end portion of the other top panel flap, the end flap being adapted to overlie the closure flap in such a carton and an end portion of the en flap being adapted to be adhered to said one end panel section.

16. A carton blank as defined in claim 15, wherein the end flap includes a tear strip adapted to overlie the closure flap in a carton formed from the blank, the tear strip being situated between the other top panel flap and the end portion of the end flap adapted to be adhered to said one end panel section.

17. A carton blank as defined in claim 13, wherein the second means on said one end panel section for maintaining the closure flap in closed position after the closure flap has been moved from open to closed position comprises a slot in said one end panel, an end portion of the closure flap being adapted to fit into the slot.

18. A carton blank as defined in claim 13, wherein said one end panel section includes score lines for distributing stresses to the bottom of a carton formed from the blank, the closure flap also including at least one score line adapted to overlie a score line in said one end panel section.

19. A carton blank as defined in claim 13, wherein the top panel flaps include portions adapted to form a handle in a carton formed from the blank.

* * * * *